US005642664A

United States Patent [19]

Schneider

[11] Patent Number: 5,642,664

[45] Date of Patent: Jul. 1, 1997

[54] HOLDING DEVICE FOR A CHAMBER DOCTOR BLADE

[75] Inventor: Georg Schneider, Würzburg, Germany

[73] Assignee: Koenig & Bauer-Albert Aktiengesellschaft, Germany

[21] Appl. No.: 555,418

[22] Filed: Nov. 9, 1995

[30] Foreign Application Priority Data

Nov. 10, 1994 [DE] Germany ..... 44 40 040.3

[51] Int. Cl.[6] ..... B41L 27/00

[52] U.S. Cl. ..... 101/123; 101/364

[58] Field of Search ..... 101/123, 114, 101/DIG. 34, 363, 169, 167, 367, 364, 350, 365, 151, 155, 207–210; 118/261, 262

[56] References Cited

U.S. PATENT DOCUMENTS 4,669,382 6/1987 Jentzsch et al. .
5,345,866 9/1994 Schneider et al. ..... 101/363
5,345,867 9/1994 Schneider et al. ..... 101/363

FOREIGN PATENT DOCUMENTS 38 32 160 1/1991 Germany .
342317 1/1931 United Kingdom .
2 266 272 10/1993 United Kingdom .
2 266 273 10/1993 United Kingdom .

*Primary Examiner*—Edgar S. Burr
*Assistant Examiner*—Anthony H. Nguyen
*Attorney, Agent, or Firm*—Jones, Tullar & Cooper, P.C.

[57] ABSTRACT

A holding device for a chamber doctor blade utilizes spaced holders which support the base body of the chamber doctor blade for sliding movement toward or away from a screen roller. This sliding movement is accomplished by spring forces exerted through a spring loaded pressure element and a pressure cam which oppose each other. The pressure cam can be shifted by an adjusting device through a spring biased tappet.

4 Claims, 3 Drawing Sheets

HOLDING DEVICE FOR A CHAMBER DOCTOR BLADE

FIELD OF THE INVENTION

The pre sent invention is directed generally to a holder for a chamber doctor blade. More particularly, the present invention is directed to a holding device for a chamber doctor blade cooperating with a screen surface ink roller of an short inking unit in a rotary printing press. Most specifically, the present invention is directed to a holding device for a chamber doctor blade that is usable to shift the doctor blade between working and retracted positions in a reproducible manner. The holding device utilizes a plurality of holders that support base bodies of the doctor blade. These base bodies are slidable along the holders toward and away from the screen surface ink roller. Each holder carries an elongated tappet whose first end is connected to a doctor blade base body contacting pressure lever arm and cam. The second end of each tappet is in contact with a rotatable eccentric disk. The tappets are slidable in their holders.

DESCRIPTION OF THE PRIOR ART

Chamber doctor blades are well known in the art and are used to provide ink to rotary printing presses. The chamber doctor blades are typically part of a so-called short inking unit that supplies ink to a screen surface ink roller. It is desirable to be able to shift the position of the doctor blade units toward or away from the surface of the screen surface ink roller. When the doctor blades are moved into their operative or working positions, in which they supply ink to the surface of the screen surface ink roller, their free ends are in engagement with the surface of the screen surface ink roller. When the doctor blades are moved to their inoperative or retracted position, their free ends are shifted away from the surface of the screen surface ink roller. Engagement of the free ends of the doctor blades with the surface of the screen surface ink roller must be with sufficient force to allow the doctor blades to function properly. Too great a force will cause unnecessary wear. The positioning of the doctor blades with respect to the screen surface ink roller surface is typically carefully adjusted so that doctor blade wear can be kept at a minimum. It is desirable to be able to shift the doctor blades to an inoperative position during breaks in the operation of the press. Clearly such a shifting is not practical if the return of the doctor blades to their operative positions will again require substantial adjusting.

In the German Patent Publication DE 38 32 160 C2 there is disclosed a device for securing and moving a chamber doctor blade. Holders for receiving and moving the chamber doctor blade are disposed on a pivotable cross arm. A limitation of this device is that no exact operating position of the chamber doctor blade can be assured because of the continuous pivoting of the cross arm.

It will thus be apparent that a need exists for a chamber doctor blade holder which overcomes the limitations of the prior art devices. The holding device for a chamber doctor blade in accordance with the present invention provides such a device and is a significant improvement over the prior art.

SUMMARY OF THE INVENTION

It is an object of the present invention to provide a holding device for a chamber doctor blade.

Another object of the present invention is to provide a holding device for a chamber doctor blade cooperating with a screen surface ink roller of an inking unit in a rotary printing press.

A further object of the present invention is to provide a holding device for a chamber doctor blade that is usable to shift the chamber doctor blade between operative and inoperative position.

Still another object of the present invention is to provide a holding device for a chamber doctor blade wherein the chamber doctor blade is returnable to an operating position in an exactly reproducible manner.

Even yet a further object of the present invention is to provide a holder for a chamber doctor blade which is operable either manually or automatically.

As will be discussed in detail in the description of the preferred embodiment which is presented subsequently, the holding device for a chamber doctor blade in accordance with the present invention utilizes holders that are secured to a cross arm which extends generally in the axial direction of the screen surface ink roller. Each of these holders has guide faces which slidingly support a base body of the chamber doctor blade. The holders each have a spring biased tappet whose first end carries a pressure lever arm with a pressure cam and whose second end is in contact with an adjusting device. The spring biased tappet is shiftable by use of the adjusting device between inoperative and working positions. In the working position, the pressure cam engages the base body of the chamber doctor blade and slides it along the guide faces of the holders to bring the free ends of the doctor blades into contact with the surface of the screen surface ink roller.

The chamber doctor blade is securely and accurately positionable in either its inoperative or its working positions and can be shifted between these positions quickly and in a reproducible manner. The stationary cross arm and the stationary holders secured to the cross arm provide a stable platform for the base body of the chamber doctor blade assembly. The work space that is needed by a press operator in order to mount and to maintain the chamber doctor blade is kept clear of interfering elements by the arrangement of the adjusting device behind the chamber doctor blade.

The adjusting device can be controlled and operated from a location remote from the area of the screen surface ink roller itself. A simple retraction of the chamber doctor blade, during brief operating interruption of the rotary printing press, can be accomplished using the holding device. This brief retraction facilitates the cleaning of the printing or inking units without the need for manual aids which would be required if the chamber doctor blade could not be shifted easily.

The holding device for a chamber doctor blade in accordance with the present invention overcomes the limitations of the prior art. It is a substantial advance in the art.

BRIEF DESCRIPTION OF THE DRAWINGS

While the novel features of the holding device for a chamber doctor blade in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
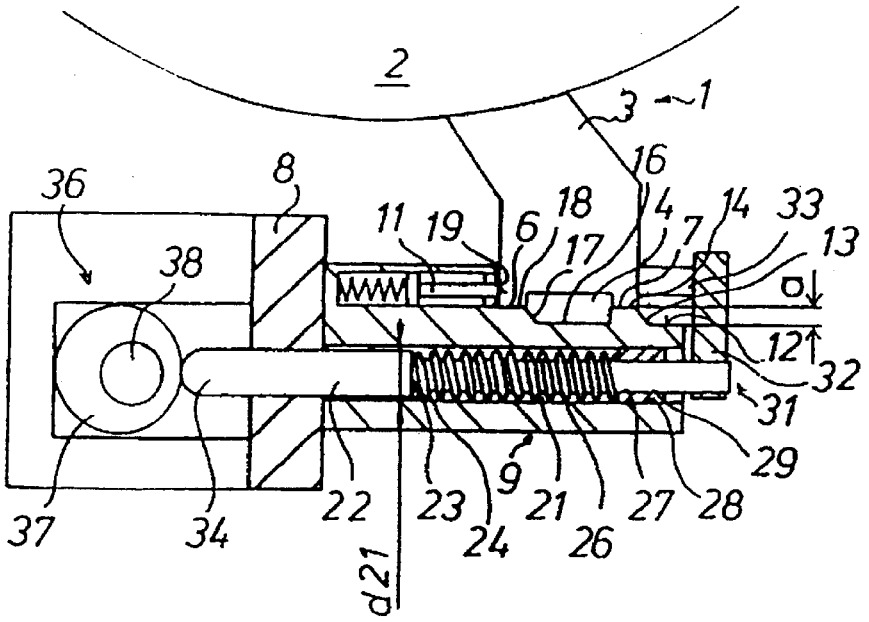
FIG. 1 is a side elevation view, partly in section and showing the holding device for a chamber doctor blade in accordance with the present invention in a working position.
Figure 2:
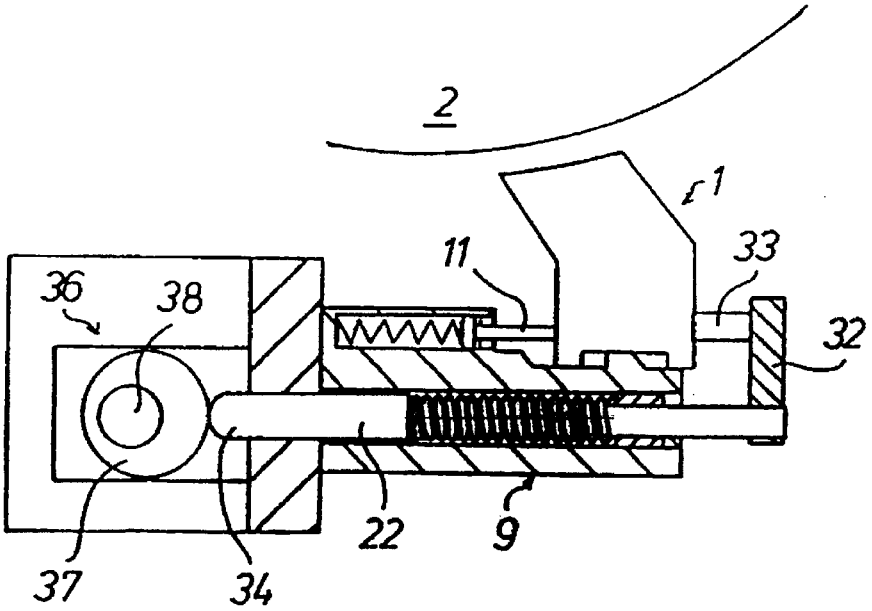
FIG. 2 is a view similar to FIG. 1 and showing the holding device in a retracted position.
Figure 3:
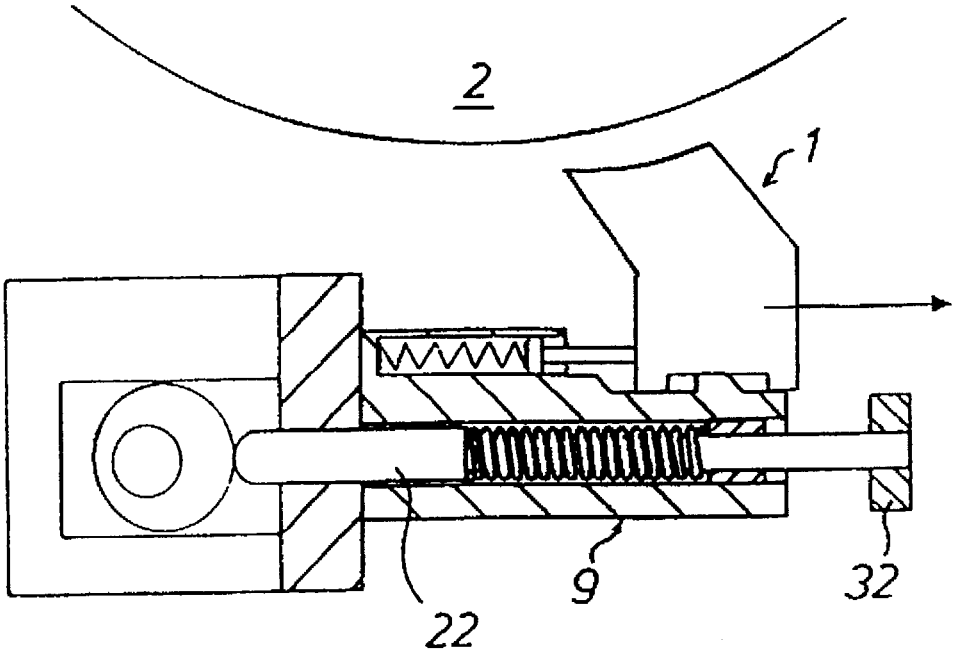
FIG. 3 is a view similar to FIG. 1 and showing the holding device positioned for removal of the chamber doctor blade from the holder.
Figure 4:
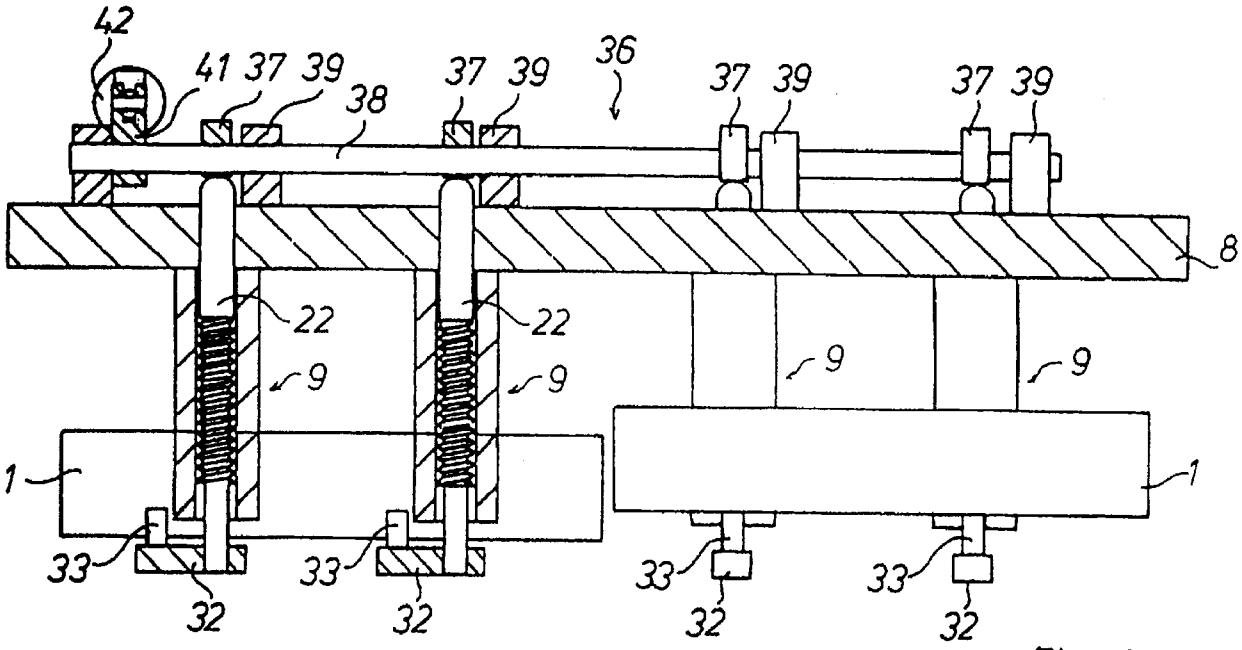
FIG. 4 is a schematic top view, partly in section, and showing the holding device in two alternate positions, one with the doctor blade removed and the other with the doctor blade in the work positions.
Figure 5:
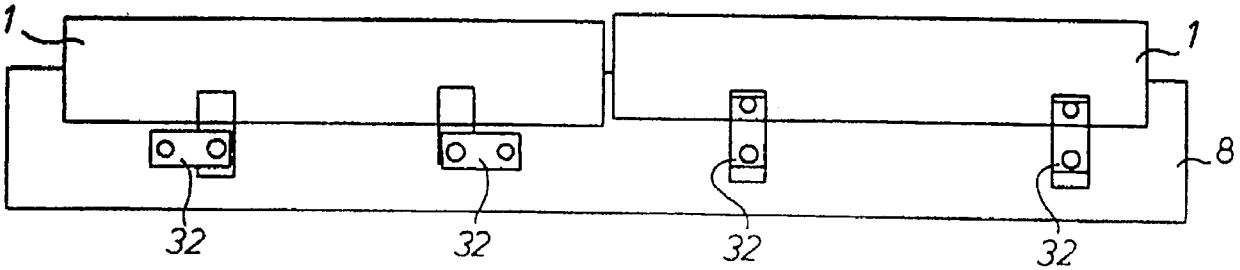
FIG. 5 is a schematic front elevation view of the holding device of FIG. 4.

Referring initially primarily to FIG. 1, and taken in conjunction with FIGS. 2 and 3, there may be seen a preferred embodiment of a holding device for a chamber doctor blade in accordance with the present invention. A chamber doctor blade, generally at 1, cooperates with a screen surface ink ink roller 2 of a short inking system for a rotary printing press. The chamber doctor blade 1 and the screen surface ink roller 2 are generally conventional in construction and operation. The screen surface ink roller rotates about an axis of rotation. The chamber doctor blade 1 extends parallel to the axis of rotation of the screen surface ink roller. As may be seen in FIGS. 4 and 5, several similar chamber doctor blades 1 can be placed next to each other along the axial length of the screen surface ink roller 2. As depicted in FIGS. 4 and 5, two such chamber doctor blades 1 can be supported adjacent a screen surface ink roller. Each chamber doctor blade 1 will extend over one half of the length of the screen surface ink roller.

As may be seen in FIGS. 1–3, the chamber doctor blade 1 has a base body 3 which is structured with a downwardly facing depression 4 on its bottom surface. This depression 4 forms front and rear sliding faces 6 and 7 on the bottom surface of-the base body 3. A cross arm 8 extends parallel to the axis of rotation of the screen surface ink roller and is attached at its ends to the spaced side frames of the press assembly, which are not specifically shown in the drawings. This cross arm 8 is also shown in FIGS. 4 and 5 and forms the basic support for the chamber doctor blade unit or units 1.

Several holders 9 extend out from the cross arm 8 in a generally cantilever manner and in a direction generally perpendicular to the longitudinal direction of the cross arm 8 and thus also generally perpendicular to the axis of rotation of the screen surface ink roller 2. As may be seen in FIGS. 4 and 5, two of these holders 9 can be used to support each chamber doctor blade unit 1.

Each doctor blade unit holder 9 has a spring loaded pressure element 11 disposed in an upper portion of the holder 9. Each of these spring loaded pressure elements 11 has a force direction which acts to the right, as shown in FIGS. 1–3 and tends to urge the chamber doctor blade units 1 away from the screen ink roller 2 to an inoperative, or retracted position which is shown in FIG. 2. The direction of force application of the upper spring loaded pressure element 11 is indicated by the arrow A shown in FIG. 3.

The holders 9 are each provided with an arrangement of upwardly facing guide faces 12, 13, 14, 16, 17 and 18. These guide faces cooperate with the front and rear sliding faces 6 and 7 of the base body 3 of the chamber doctor blade 1. The guide faces 14 and 18 are the uppermost of these several guide faces on the holders 9 and are closest to the surface of the screen surface ink roller 2. They are elevated at a distance "a" above the lower guide faces 12 and 16. The upper guide faces 14 and 18 are generally parallel to the lower guide faces 12 and 16. The two upper guide faces 14 and 18 are connected to the two lower guide faces 12 and 16 by intermediate inclined or wedge shaped guide faces 13 and 17. The depression 4 on the lower surface of the base body 3 of the chamber doctor blade 1 is deeper than the height "a" of the upper guide faces 14 and 18 above the lower guide faces 12 and 16 on the holders 9. As may be seen by comparing FIGS. 1 and 2, as the base body 3 is shifted from its operational or work position shown in FIG. 1 to its retracted position, as shown in FIG. 2, the front and rear sliding faces 6 and 7 of the base body 3 will first slide on the upper guide faces 14 and 18; will then slide down the inclined guide faces 13 and 17; and will then slide on the lower guide faces 12 and 16. This sliding movement is under the influence of the 5 spring loaded pressure element 11.

Again referring to FIGS. 1–3, each holder 9 is provided with a lower bore 21 which is located beneath the guide faces 12–14 and 16–18. This elongated bore 21 has a diameter "d21", and extends through the cross arm 8. An elongated tappet 22, which has a circular cross-sectional shape, is placed in each lower bore 21 and is slidable in the axial direction in the bore 21. The tappet 22 can also rotate in the circumferential direction of the bore 21. Tappet 22 is divided into a larger diameter portion and a smaller diameter portion. As shown in FIGS. 1–3, the smaller diameter portion has a first end which passes through a bore 29 of a bushing 28 that is secured in the elongated bore 21 generally at the free end of the holder 9. The larger diameter portion of the tappet 22 passes through the bore extension in the cross arm 8. A stop 23 for a first end 24 of a pressure spring 26 is formed at the point where the tappet 21 changes diameter. This pressure spring 26 is concentric with, and encircles a portion of the smaller diameter part of the tappet 21. A second end 27 of the pressure spring 26 acts against the bushing 28 that is secured in the elongated bore that receives the tappet 22. As discussed above, this bushing 28 is fastened in the bore 21 and its interior bore 29 is used as a seat for the smaller diameter portion of the tappet 22. The force of the pressure spring 26 acting on the stop 23 of the tappet 22 urges the tappet to the left, as shown in FIGS. 1, 2 and 3. The total force exerted by the pressure springs 26 is greater than the total force exerted by the spring loaded pressure elements 11 and thus the chamber doctor blades 1 are urged into their work positions, as depicted in FIG. 1.

A pressure lever arm 32 is attached to the first end 31 of the tappet 22 which extends out beyond the free end of the holder 9; i.e. the end of tappet 22 that is remote from the cross arm 8. This pressure lever arm 32 carries a pressure cam 33 that engages the base body 3 of the chamber doctor blade 1. As may be seen in FIGS. 1–3, the pressure cam engages the base body 3 on its side opposite to the base body side that is contacted by the spring located pressure element 11. As discussed above, since the force created by the spring 26 is greater than the force created by the pressure element 11, the base body tends to be forced to the left into its work position, as depicted in FIG. 1.

A second end 34 of the tappet 22 extends through the bore in the cross arm 8 and engages a tappet adjusting device, generally at 36. This adjusting device 36 includes an adjusting shaft 38 which is supported for rotation in suitable bearing blocks 39, as may be seen most clearly in FIG. 4. These bearing blocks 39 are secured to the cross arm 8 on a cross arm face that is opposite to the face of cross arm 8 to which the holders 9 for the base body 3 are secured. The adjusting shaft 38 extends generally parallel to the screen surface ink roller 2 and their axes of rotation are parallel. A plurality of eccentric disks 37 are fastened to the adjusting shaft 38 and are spaced along shaft 38 so that they will cooperatively engage the second ends 34 of the tappets 22 in the spaced holders 9. A lever arm 41 is fastened to one end of the adjusting shaft 38 and is connected to an adjusting drive, generally at 42. This adjusting drive 42 may be a pneumatic cylinder, or another source of power that will be able to move the adjusting lever arm 41 sufficiently to rotate the adjusting shaft 38 and the eccentric disks 37 through generally 180° The pneumatic cylinder or other adjusting drive 42 is secured to the frame of the printing press.

As may be seen most clearly in FIGS. 4 and 5, two chamber doctor blades 1 are situated along the length of the screen surface ink roller 2. Each chamber doctor blade 1 is supported by two holders 9 and a single adjusting shaft 38 extends the length of the screen surface ink roller 2. This single adjusting shaft 38 thus adjusts the position of both of the chamber doctor blades 1. It would also be possible, in accordance with the present invention, to center the tappet 22 with respect to each chamber doctor blade 1 and to support this central tappet independently of the holders 9 which are provided with the guide faces 12, 13, 14, 16, 17 and 18. Each chamber doctor blade 1 can also be provided with its own adjusting shaft 38 and with its own adjusting drive 42.

With the chamber doctor blade 1 in its operating position, as depicted in FIG. 1, the pressure cams 33 press against the base body 3 of the chamber doctor blade 1 through the force of the pressure lever arms 32. This causes the base body 3 to engage a stop face 19 on the holder 9. The base body is supported by its front and rear sliding faces 4 and 6 on the upper guide faces 18 and 14, respectively. A defined position of the chamber doctor blade 1 with respect to the screen surface ink roller 2 is insured by this abutment of the base body 3 against the stop face 19. The required force supplied to the base body 3 through the pressure cam 33 and the pressure lever arm 32 is generated by the pressure spring 26 whose first end 24 engages the tappet stop 23 and whose second end 27 engages the end of the bushing 28. This spring force urges the tappet 22 to the left, as seen in FIG. 1; i.e. in the direction toward the tappet adjusting device 36. In this operating or work position depicted in FIG. 1, the eccentric disks 37 are situated with their enlarged eccentric lobe portions not in contact with the second ends 34 of the tappets 22.

When the chamber doctor blade 1 is to be moved to its retracted position, as depicted in FIG. 2, the adjusting drive 42 is actuated and moves the adjusting lever arm 41 to cause a rotation of the adjusting shaft 38 through generally 180° The eccentric disks 37 are rotated also through generally 180° so that their enlarged lobe portions will engage the second ends 34 of the tappet 22 and will shift these tappets 22 to the right, into the retracted position shown in FIG. 2. This shifting of the tappets 22 moves the pressure cams 32 also to the right. The base body 3 will now also move to the right due to the force applied to it by the spring loaded pressure element 11. The sliding faces 4 and 6 on the base body 1 will slide across the upper guide faces 18 and 14, down the inclined or wedge shaped guide faces 17 and 13, and along the lower guide faces 16 and 12 on the upper surface of the holder 9, as seen in FIGS. 1 and 2.

If the chamber doctor blade 1 is to be physically removed from the holder 9, the tappet 22 can be rotated through 90°, as shown in FIG. 3 and on the left in FIG. 5. This will rotate the pressure lever arms 32 to a laid over position where they are not in the path of continued sliding movement of the chamber doctor blade 11 to the right so that the chamber doctor blade 1 can be physically separated from its support holders 9.

While a preferred embodiment of a holding device for a chamber doctor blade in accordance with the present invention has been set forth fully and completely hereinabove, it will be apparent to one of skill in the art that a number of changes in, for example, the overall size of the chamber doctor blade, the overall size of the screen surface ink roller, the drive for the screen surface ink roller and the like may be made without departing from the true spirit and scope of the present invention which is accordingly to be limited only by the following claims.

What is claimed is:

1. A holding device for a chamber doctor blade in a printing press comprising:

a chamber doctor blade base body having spaced front and rear lower sliding faces;

a plurality of spaced chamber doctor blade holders, each of said chamber doctor blade holders having base body guide surfaces upon which said sliding faces of said base body are supported, and an upper bore and a lower bore;

a plurality of spring loaded pressure elements, each said spring loaded pressure element being slideably supported in one of said upper bores in said holders, each said spring loaded pressure element having a first spring exerting a first spring force, each said spring loaded pressure element engaging said base body to urge said base body to a retracted position on said holders away from a screen surface ink roller;

a plurality of spring biased tappets, each said spring biased tappet being slideably supported in one of said lower bores in one of said holders, each said tappet having a second spring exerting a second spring force greater than said first spring force, each said spring biased tappet having a first end with a pressure lever arm and a pressure cam engaging said base body to urge said base body to a working position toward a screen surface ink roller; and an adjusting device usable to concurrently shift said plurality of spring biased tappet in said holders in a direction of a longitudinal axis of each of said tappets between said working position and said retracted position, said adjusting device including a rotatable adjusting shaft with a plurality of eccentric disks spaced along said adjusting shaft, each of said eccentric disks being in engagement with a second end of a corresponding one of said tappets, rotation of said adjusting shaft causing said tappets to slide in said bores to move said base body on said spaced holders.

2. The holding device in accordance with claim 1 further including a cross arm and wherein each of said spaced holders has a first end secured to said cross arm.

3. The holding device of claim 1 wherein said spring biased tappet in each of said holders is rotatable about said longitudinal axis.

4. The holding device of claim 1 further including an adjusting drive and an adjusting lever arm, said adjusting lever arm extending between said adjusting drive and said adjusting shaft, whereby operation of said adjusting drive will rotate said adjusting shaft.

* * * * *